US010448190B2

(12) United States Patent
Goller

(10) Patent No.: US 10,448,190 B2
(45) Date of Patent: Oct. 15, 2019

(54) LOUDSPEAKER DEVICE OR SYSTEM WITH CONTROLLED SOUND FIELDS

(71) Applicant: BANG & OLUFSEN A/S, Stuer (DK)

(72) Inventor: Lars Goller, Herning (DK)

(73) Assignee: BANG & OLUFSEN A/S, Struer (DK)

( * ) Notice: Subject to any disclaimer, the term of this patent is extended or adjusted under 35 U.S.C. 154(b) by 0 days.

(21) Appl. No.: 15/778,824

(22) PCT Filed: Nov. 24, 2016

(86) PCT No.: PCT/DK2016/000045
§ 371 (c)(1),
(2) Date: May 24, 2018

(87) PCT Pub. No.: WO2017/088876
PCT Pub. Date: Jun. 1, 2017

(65) Prior Publication Data

US 2018/0359593 A1 Dec. 13, 2018

(30) Foreign Application Priority Data

Nov. 25, 2015 (DK) ..... 2015 00751

(51) Int. Cl.
*H04S 7/00* (2006.01)
*H04R 5/02* (2006.01)
(Continued)

(52) U.S. Cl.
CPC ..... *H04S 7/303* (2013.01); *H04R 1/24* (2013.01); *H04R 1/2826* (2013.01);
(Continued)

(58) Field of Classification Search
CPC ..... H04S 7/303; H04S 3/008; H04S 2400/01; H04S 7/302; H04R 1/02; H04R 1/24;
(Continued)

(56) References Cited

U.S. PATENT DOCUMENTS 4,764,960 A 8/1988 Aoki et al.
4,961,226 A * 10/1990 Saffran ..... H04R 1/02 381/303

(Continued)

FOREIGN PATENT DOCUMENTS

EP 0624047 A1 11/1994

OTHER PUBLICATIONS

International Search Report for International Application No. PCT/DK2016/000045, dated Oct. 7, 2017.

*Primary Examiner* — Jason R Kurr
(74) *Attorney, Agent, or Firm* — Hunton Andrews Kurth LLP

(57) ABSTRACT

The invention relates to a loudspeaker system or device configured such that the sound field generated by the system or device is controllable. The system or device comprises Left (16, 18; 41, 43) and Right (15, 17; 42, 46) loudspeaker arrangements configured for radiating at least mid and high frequency sounds to the surroundings (R) and for controlling the sound radiation pattern (21, 22, 23, 24, 25, 26) of the left and right loudspeaker arrangements, respectively, such that the beam width and/or direction of the main lobe of the directivity pattern for the respective Left and Right loudspeaker arrangements can be varied; and at least one signal processor configured to process the signals to be provided to the loudspeakers of the respective loudspeaker arrangements such that the directional characteristics of the loudspeakers in each respective arrangement can be varied. The system or device may further comprise a low frequency arrangement comprising an arrangement of one or more loudspeakers (11, 12, 13, 14, 37) mounted in an enclosure (1) and configured such that the loudspeakers radiates sound energy to the surroundings (R). The low frequency arrangement may be configured as a bass-reflex enclosure with a wide port region. By means of the system or device according to the
(Continued)

invention, the resulting directional characteristic of the system or device can be adapted to numerous specific use situations, for instance to obtain a stereo-stabilizing effect on a perceived sound image.

28 Claims, 9 Drawing Sheets

(51) Int. Cl.
*H04R 1/28* (2006.01)
*H04R 1/24* (2006.01)
*H04S 3/00* (2006.01)

(52) U.S. Cl.
CPC ..... *H04R 1/2865* (2013.01); *H04R 5/02* (2013.01); *H04S 3/008* (2013.01); *H04S 7/302* (2013.01); *H04S 2400/01* (2013.01)

(58) Field of Classification Search
CPC ..... H04R 5/02; H04R 1/2826; H04R 1/20; H04R 1/26; H04R 1/323; H04R 1/2815; H04R 1/2823; H04R 1/2849; H04R 1/2853; H04R 1/2857; H04R 1/2865
See application file for complete search history.

(56) References Cited

U.S. PATENT DOCUMENTS

| | | | | |
|---|---|---|---|---|
| 8,256,566 | B1 * | 9/2012 | Rodgers | H04R 1/2826 181/144 |
| 2004/0105559 | A1 * | 6/2004 | Aylward | H03G 5/165 381/103 |
| 2006/0159289 | A1 | 7/2006 | Stiles | |
| 2008/0044038 | A1 | 2/2008 | Houle | |
| 2009/0260915 | A1 | 10/2009 | Arai | |
| 2010/0202619 | A1 * | 8/2010 | Vincenot | G10K 11/346 381/17 |
| 2012/0263325 | A1 * | 10/2012 | Freeman | H04S 3/008 381/120 |
| 2013/0259254 | A1 | 10/2013 | Xiang et al. | |
| 2015/0223002 | A1 * | 8/2015 | Mehta | H04S 7/30 381/303 |

* cited by examiner

LOUDSPEAKER DEVICE OR SYSTEM WITH CONTROLLED SOUND FIELDS

CROSS-REFERENCE TO RELATED APPLICATIONS

The present application is a National Stage Application under 35 U.S.C. § 371 of PCT/DK2016/000045, filed Nov. 24, 2016, which claims priority to DK Priority Application Number PA 2015 00751, filed Nov. 25, 2015, the contents of each of which are hereby incorporated by reference in their entireties, for all purposes.

TECHNICAL FIELD

The present invention relates generally to devices comprising multiple loudspeakers and more specifically to such devices comprising controllable directional characteristics.

BACKGROUND OF THE INVENTION

In a stereophonic sound reproduction setup comprising a left and a right loudspeaker radiating sound into a listening area in front of the loudspeakers, optimal stereophonic sound reproduction can be obtained in the symmetry plane between the two loudspeakers. Hence, if substantially identical signals are provided to the two loudspeakers, a listener sitting in front of the loudspeakers in the symmetry plane will perceive a sound image in the symmetry plane between the loudspeakers. However, if the listener for instance moves to the right relative to the symmetry plane, the distance between the listener and the right loudspeaker will decrease and the distance between the listener and the left loudspeaker will increase, resulting in that the perceived sound image will move in the direction of the right loudspeaker, even though identical signals are still applied to the two loudspeakers. Thus, generally, the perceived position of specific sound images in the total stereo image (for instance resembling a singer or a specific instrument in an orchestra) will depend on the lateral position of the listener relative to the loudspeaker setup. This effect is however not desirable, as a stable stereophonic sound image is desired, i.e. a sound image in which the position in space of each specific detail of the sound image, such as for instance the position of a singer, remains unchanged, when the listener moves laterally in front of the loudspeakers, as it would do, if the listener was listening to a real singer standing somewhere at a stage for instance surrounded by an orchestra. Consequently there is a need for a stereophonic loudspeaker setup that does not suffer from this disadvantageous effect of the position of the listener relative to the loudspeaker setup on the perceived sound image.

Furthermore, the directional characteristics of the loudspeaker units used in traditional stereophonic loudspeaker systems depend on frequency. At low frequencies a loudspeaker unit may have a substantially omnidirectional characteristic, radiating sound energy substantially equally in all directions. However, at mid frequencies and even more at high frequencies the directional characteristic tend to be more and more narrow, such that the loudspeaker unit predominantly radiates sound energy in a narrow beam in the direction of the loudspeaker symmetry axis. This may cause deteriorated sound reproduction for a listener positioned off-axis relative to the loudspeaker system. Hence, there is a need for a loudspeaker system with a directional characteristic with reduced dependency on frequency.

DISCLOSURE OF THE INVENTION

On the above background it is an object of the present invention to provide a loudspeaker system or device that maintains a stable stereophonic sound image at least in the region in front of the loudspeaker system or device, such that lateral displacements of a listener relative to the loudspeaker system or device will not materially affect the perceived stereophonic image.

It is a further object of the invention to provide a loudspeaker system or device that can be optimized to specific use situations, for instance (but not limited to) optimized for use as a sound bar in connection with a television set or a stereo sound rendering device in connection with a personal computer or for use in the cabin of a car.

It is a further object of the invention to provide a loudspeaker system or device with reduced change of directivity pattern versus frequency.

It is a further object of the invention to provide a loudspeaker system or device in which the direction and/or beam widths of the main lobes of the system or device can be controlled in order to obtain optimal listening conditions in various use situations.

The above and further objects and advantages are obtained by the loudspeaker system and loudspeaker device according to the present invention comprising a multiple loudspeaker configuration that provides for an adaptation of beam direction and beam direction that is optimal for each specific use case.

According to a first aspect of the present invention there is provided a loudspeaker system configured such that the sound field generated by the system is controllable, where the system comprises:

Left and Right loudspeaker arrangements configured for radiating at least mid and high frequency sounds to the surroundings (R) and for controlling the sound radiation pattern of the left and right loudspeaker arrangements, respectively, such that the beam width and/or direction of the main lobe of the directivity pattern for the respective Left and Right loudspeaker arrangements can be varied;

at least one signal processor configured to process the signals to be provided to the loudspeakers of the respective loudspeaker arrangements such that the directional characteristics, such as the beam width and/or the direction of the main lobe of the directivity pattern of the loudspeakers, in each respective arrangement can be varied;

whereby the resulting directional characteristic of the system can be adapted to specific use situations.

In an embodiment of the first aspect the Left loudspeaker arrangement comprises at least two loudspeakers provided in a front face of the Left loudspeaker arrangement, and the Right loudspeaker arrangement comprises at least two loudspeakers provided in a front face of the Right loudspeaker arrangement, with at least one loudspeaker in the respective loudspeaker arrangement having an axis (C) substantially perpendicular to the front face of the respective loudspeaker arrangement and at least one loudspeaker having an axis (D, E) that is inclined an angle substantially different from the axis (C) of the first loudspeaker.

In an embodiment of the first aspect the at least two loudspeakers in the Left loudspeaker arrangement are provided side by side in the lateral direction (x) of the system, and the at least two loudspeakers in the Right loudspeaker arrangement are provided side by side in a lateral direction (x) of the system.

In an embodiment of the first aspect the at least two loudspeakers in the Left loudspeaker arrangement are provided above each other, i.e. substantially in the direction of the z-axis (perpendicularly to the lateral direction x).

In an embodiment of the first aspect, the directional characteristic of the combined Left and Right loudspeaker arrangements, respectively, have a relatively large beam width with maximum sound radiation at an inclined angle relative to the front face of the loudspeaker system, where the direction of the maximum of the directional characteristic points towards a point P in front of the loudspeaker system at a distance from the front face of the system. Preferably, said point P lies in the symmetry plane of the loudspeaker system, although a position of P off the symmetry plane would also be possible and would be within the scope of the present invention. When configured in this manner, the provision of the respective Left and Right loudspeaker arrangements with identical signals (for instance representing a singer located in the symmetry plane of the loudspeaker set-up) will result in that a listener located in the symmetry plane at a distance in front of the loudspeaker system (not necessarily at point P) will receive equally strong sound signals from either of the loudspeaker combinations and hence will perceive the sound image (of the singer) in the desired position in the symmetry plane. However, when the listener is for instance moving laterally to the right, still keeping the same distance from a line between the respective loudspeaker arrangements, the magnitude of the sound radiated by the Right loudspeaker arrangement will decrease due to the directional characteristic of the Right loudspeaker arrangement, whereas the magnitude of the sound radiated by the Left loudspeaker arrangement will increase due to the directional characteristic of the Left loudspeaker arrangement. With a proper choice of directional characteristics of the respective Left and Right loudspeaker arrangements this will have the effect that the perceived sound image (in this example of the singer) will remain substantially at its original position in the symmetry plane despite the fact that the listener has moved laterally relative to the system. Consequently, a stereo image stabilizing effect has been achieved as desired.

In an embodiment of the first aspect the system further comprises a low frequency arrangement comprising an arrangement of one or more loudspeakers mounted in an enclosure and configured such that the loudspeakers radiates sound energy to the surroundings R.

In an embodiment of the first aspect the enclosure is configured as a bass-reflex enclosure, which enclosure is provided with a bass-reflex sound channel having an inlet area configured to receive sound energy from the loudspeakers in the low frequency arrangement and an exit or port area configured to provide sound energy to the surroundings R, where the port area is substantially larger than the inlet area, such that volume velocity of sound generated by said loudspeakers in the channel is reduced in the port area relative to the inlet area leading to reduced port noise, whereby sound quality at low frequencies is improved, when high intensity low frequency sounds are reproduced by the low frequency arrangement.

In an embodiment of the first aspect the enclosure comprises an inner house portion and an outer house portion, where the outer house portion partially surrounds the inner house portion thereby forming a channel or gab between the inner and outer house portions, and where the inner house portion defines an inner space or cavity that is in acoustic communication via an inlet portion with said channel or gab, the inlet portion defining an inlet area to the channel or gab, and where said channel or gab is in acoustic communication with the surroundings R via an outlet opening or port defining a port area, and wherein said one or more loudspeakers are configured to radiate sound energy into said space or cavity, and where said port area is substantially larger than said inlet area, thereby reducing the volume velocity of the sound in the port area substantially relative to the volume velocity of the sound in the inlet area, whereby port noise will be reduced and consequently the sound quality of the sound produced by the system at low frequencies will be improved.

In an embodiment of the first aspect the system is configured substantially symmetrically about a symmetry plane (y, z) such that said Left and Right loudspeaker arrangements, respectively are positioned substantially symmetrically about the symmetry plane (y, z) in the lateral direction (x) of the system.

In an embodiment of the first aspect the system comprises at least one high frequency loudspeaker, at least one of which is located substantially at the symmetry plane of the system.

In an embodiment of the first aspect the loudspeaker system is provided with a control system configured to control the directional characteristics of the individual loudspeakers of the loudspeaker system, the control system comprising:

- a plurality of digital signal processors each having an input and an output, each processors configured to provide a processed version of the an input signal at the output of the respective processor;
- an input terminal for receiving the input signal;
- output terminals for providing processed versions of the input signal to the respective loudspeakers;
- output selection means configured to select processed outputs from one or more of the digital signal processors and to provide the selected outputs to predefined loudspeakers in the system.

In an embodiment of the first aspect the digital signal processors are configured to provide an output that is any combination of frequency weighted, time-delayed, phase-modified or gain-modified versions of the input to the respective signal processor.

In an embodiment of the first aspect, the respective directional characteristics of the Left and Right loudspeaker arrangements are optimized to provide a stabilizing effect on a stereo-image perceived by a listener at different positions in front of the loudspeaker system.

In an embodiment of the first aspect, the direction of the main lobe of the directional characteristic of the Left loudspeaker arrangement is inclined an angle $\beta$ relative to a line between the Left and Right loudspeaker arrangement and wherein the direction of the main lobe of the directional characteristic of the Right loudspeaker arrangement is inclined an angle $\gamma$ relative to the line between the Left and Right loudspeaker arrangement, where $\beta$ and $\gamma$ are less than 90 degrees.

In an embodiment of the first aspect, the angles $\beta$ and $\gamma$ are less than 80 degrees, preferably less than 70 degrees and still more preferably less than 60 degrees.

In an embodiment of the first aspect, the Left and Right loudspeaker arrangements are symmetrical about a symmetry plane defined by x=0.

In an embodiment of the first aspect it is given that for listening points located in the lateral direction x on a line in front of and substantially parallel to a line between the Left and Right loudspeaker arrangements, the ratio between the magnitudes of the directional characteristic of the Right loudspeaker arrangement and the magnitude of the directional characteristic of the Left loudspeaker arrangement is substantially equal to a quantity C multiplied by the ratio between the distance between the Right loudspeaker arrangement and the listening point and the distance between the Left loudspeaker arrangement and the listening point.

In an embodiment of the first aspect, the quantity C is substantially constant within a predetermined frequency range.

In an embodiment of the first aspect, the predetermined frequency range is the frequency range regarded as the most important for determining the location of a perceived sound image (virtual sound source) in a stereophonic set-up.

In an embodiment of the first aspect, the predetermined frequency range comprises the range from approximately 500 Hz to 2000 Hz.

According to a second aspect of the present invention there is provided loudspeaker device configured such that the sound field generated by the device is controllable comprising:

- a housing provided with a front face (8) extending substantially in a lateral direction (x),
- a Left loudspeaker arrangement comprising at least two loudspeakers provided in the front face and configured to radiate sound energy into the surroundings R;
- a Right loudspeaker arrangement comprising at least two loudspeakers provided in the front face to the right of said left loudspeaker arrangement and configured to radiate sound energy into the surroundings R;
- wherein a first of said loudspeakers in the Left loudspeaker arrangement has a loudspeaker axis oriented substantially perpendicular the front face and a second of said loudspeakers in the Left loudspeaker arrangement has a loudspeaker axis extending at an angle $\alpha$ in the (x, y) plane relative to the loudspeaker axis of the first loudspeaker that differs from zero; and
- wherein a first of said loudspeakers in the Right loudspeaker arrangement has a loudspeaker axis oriented substantially perpendicular the front face and a second of said loudspeakers in the Right loudspeaker arrangement has a loudspeaker axis extending at an angle $\alpha$ in the (x, y) plane relative to the loudspeaker axis of the first loudspeaker that differs from zero.

The respective x, y and z axis are defined with reference to the FIGS. 1, 2 and 3 that are described in detail in the detailed description of the invention.

In an embodiment of the second aspect the device further comprising one or more low frequency loudspeakers configured to radiate sound energy into the surroundings R.

In an embodiment of the second aspect the low frequency loudspeakers are provided in said front face.

In an embodiment of the second aspect the housing has a generally elongated shape extending in a lateral direction (x) on either side of a symmetry plane (y, z).

In an embodiment of the second aspect one loudspeaker in the Left loudspeaker arrangement has a loudspeaker axes (E) that points in a direction towards said symmetry plane, and one loudspeaker in the Right loudspeaker arrangement has a loudspeaker axes (D) that points in a direction towards said symmetry plane.

In an embodiment of the second aspect the device is substantially symmetrical about the symmetry plane.

In an embodiment of the second aspect, the directional characteristic of the combined Left and Right loudspeaker arrangements, respectively, have a relatively large beam width with maximum sound radiation at an inclined angle relative to the front face of the loudspeaker device, where the direction of the maximum of the directional characteristic points towards a point P in front of the loudspeaker device at a distance from the front face of the device. Preferably, said point P lies in the symmetry plane of the loudspeaker device, although a position of P off the symmetry plane would also be possible and would be within the scope of the present invention. When configured in this manner, the provision of the respective Left and Right loudspeaker arrangements with identical signals (for instance representing a singer located in the symmetry plane of the loudspeaker set-up) will result in that a listener located in the symmetry plane at a distance in front of the loudspeaker device (not necessarily at point P) will receive equally strong sound signals from either of the loudspeaker combinations and hence will perceive the sound image (of the singer) in the desired position in the symmetry plane of the device. When the listener is for instance moving laterally to the right, still keeping the same distance from a line between the respective loudspeaker arrangements, the magnitude of the sound radiated by the Right loudspeaker arrangement will decrease due to the directional characteristic of the Right loudspeaker arrangement, whereas the magnitude of the sound radiated by the Left loudspeaker arrangement will increase due to the directional characteristic of the Left loudspeaker arrangement. With a proper choice of directional characteristics of the respective Left and Right loudspeaker arrangements this will have the effect that the perceived sound image (in this example of the singer) will remain substantially at its original position in the symmetry plane of the device despite the fact that the listener has moved laterally relative to the device. Consequently, a stereo image stabilizing effect has been achieved as desired.

In an embodiment of the second aspect the housing comprises an inner house portion and an outer house portion, where the outer house portion partially surrounds the inner house portion thereby forming a channel or gap between the inner and outer house portions, and the inner house portion defines an inner space or cavity that is in acoustic communication via a portion with the channel or gap, the portion defining an inlet area to the channel or gap, and the channel or gap is in acoustic communication with the surroundings R via an outlet opening or port defining a port area, and the one or more loudspeakers are configured to radiate sound energy into said space or cavity, and the port area is substantially larger than the inlet area, thereby reducing the volume velocity of the sound in the port area substantially relative to the volume velocity of the sound in the inlet area, whereby port noise will be reduced and consequently the sound quality of the sound produced by the system at low frequencies will be improved when high intensity low frequency sounds are reproduced by the low frequency arrangement.

In an embodiment of the second aspect the device further comprises a high frequency loudspeaker provided in the front face.

In an embodiment of the second aspect the high frequency loudspeaker is provided substantially in the symmetry plane.

In an embodiment of the second aspect the loudspeaker device is provided with a control system configured to control the directional characteristics of the individual loudspeakers of the loudspeaker device, the control system comprising:

- a plurality of digital signal processors each having an input and an output, each processor configured to provide a processed version of the input signal at the output of the respective processor;

an input terminal for receiving the input signal;

output terminals for providing processed versions of the input signal to the respective loudspeakers;

output selection means configured to select processed outputs from one or more of the digital signal processors and to provide the selected outputs to predefined loudspeakers in the device.

In an embodiment of the second aspect the digital signal processors are configured to provide an output signal that is any combination of frequency weighted, time-delayed, phase-modified or gain-modified versions of the input signal to the respective signal processor.

In an embodiment of the second aspect, the respective directional characteristics of the Left and Right loudspeaker arrangements are optimized to provide a stabilizing effect on a stereo-image perceived by a listener at different positions in front of the loudspeaker device.

In an embodiment of the second aspect, the direction of the main lobe of the directional characteristic of the Left loudspeaker arrangement is inclined an angle $\beta$ relative to a line between the Left and Right loudspeaker arrangement and the direction of the main lobe of the directional characteristic of the Right loudspeaker arrangement is inclined an angle $\gamma$ relative to the line between the Left and Right loudspeaker arrangement, where $\beta$ and $\gamma$ are less than 90 degrees.

In an embodiment of the second aspect, the angles $\beta$ and $\gamma$ are less than 80 degrees, preferably less than 70 degrees and still more preferably less than 60 degrees.

In an embodiment of the second aspect, the Left and Right loudspeaker arrangements are symmetrical about a symmetry plane.

In an embodiment of the second aspect it is given that for listening points located in the lateral direction x on a line in front of and substantially parallel to a line between the Left and Right loudspeaker arrangements (or a front face of the device), the ratio between the magnitude of the directional characteristic of the Right loudspeaker arrangement and the magnitude of the directional characteristic of the Left loudspeaker arrangement is substantially equal to a quantity C multiplied by the ratio between the distance between the Right loudspeaker arrangement and the listening point and the distance between the Left loudspeaker arrangement and the listening point.

In an embodiment of the second aspect, the quantity C is substantially constant within a predetermined frequency range.

In an embodiment of the second aspect, the predetermined frequency range is the frequency range regarded as the most important for determining the location of a perceived sound image (virtual sound source) in a stereophonic set-up.

In an embodiment of the second aspect, the predetermined frequency range comprises the range from approximately 500 Hz to 2000 Hz.

According to a third aspect of the present invention there is provided a method for stabilizing a stereophonic sound image created by at least a Left loudspeaker arrangement and a Right loudspeaker arrangement placed a given distance apart along a line L, where the respective directional characteristics $D_L$ and $D_R$ are chosen such that at a listening point L(x) in front of the loudspeaker arrangements at a given distance from the line L, the ratio between the magnitude of the directional characteristics $D_L$ and $D_R$ is substantially equal to a quantity C multiplied by the ratio between the distance $r_L$ from the Left loudspeaker arrangement to the listening point L(x) and the distance $r_R$ from the right loudspeaker arrangement to the listening point L(x).

In an embodiment of the third aspect, the quantity C is substantially constant.

In an embodiment of the third aspect, the quantity C is substantially equal to unity.

It is noted that although an embodiment of a device according to the invention is described in the detailed description of the invention that comprises a housing in which all loudspeakers are mounted in this housing, the invention is not limited to such a single-housing configuration. Thus, various parts of the invention comprising one or some of the total number of loudspeakers used according to the invention may be used, thereby forming a system of loudspeakers functioning according to the basic principles of the invention. An example embodiment of such a system will briefly be described in the detailed description of the invention.

BRIEF DESCRIPTION OF THE DRAWINGS

Further benefits and advantages of the present invention will become apparent after reading the detailed description of non-limiting exemplary embodiments of the invention in conjunction with the accompanying drawings, wherein.

DETAILED DESCRIPTION OF THE INVENTION

In the following a detailed description of an example embodiment of the invention is given. It is, however understood that the principles of the invention could be embodied in other ways.

Figure 1:
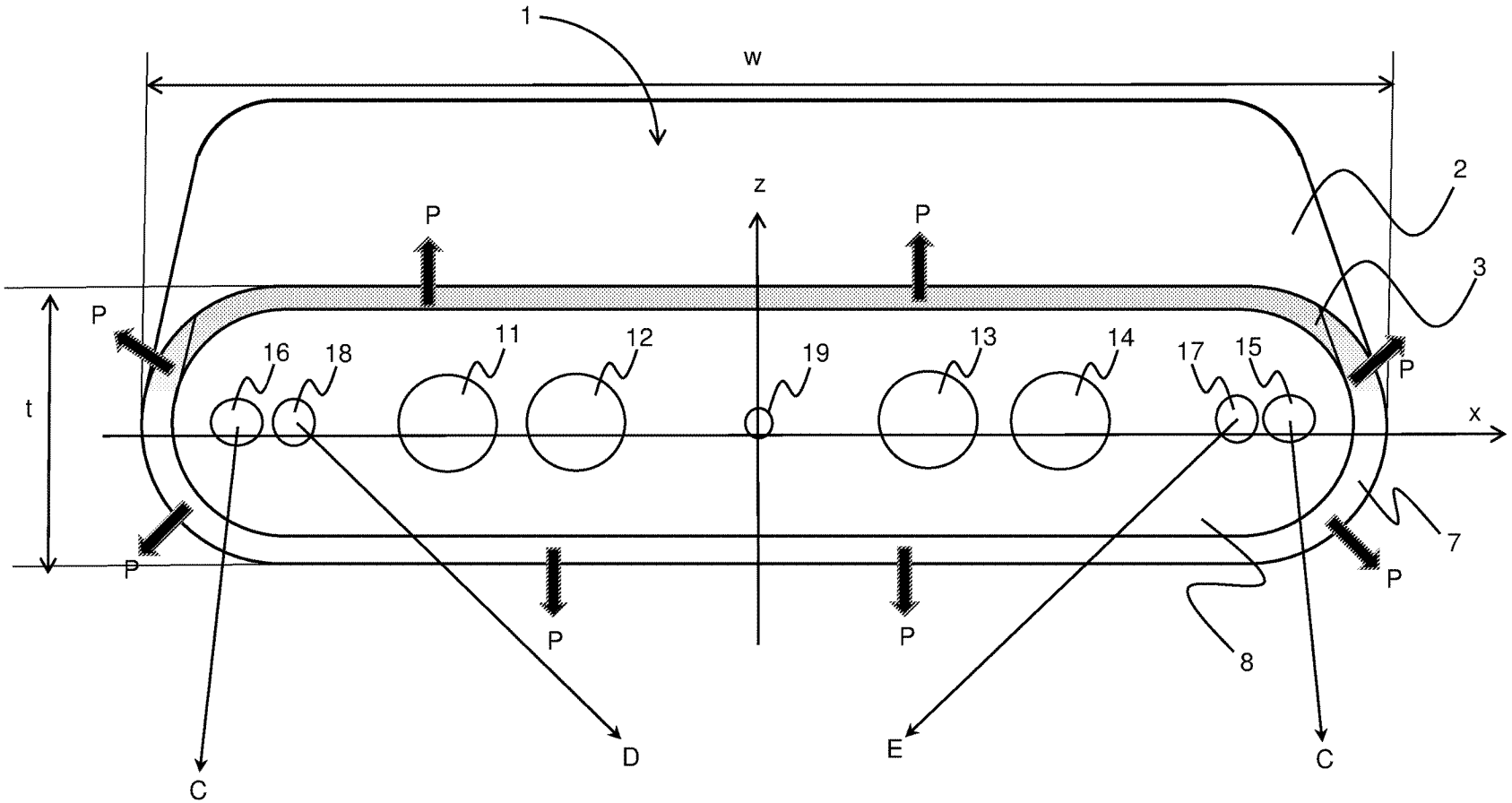
FIG. 1 shows a schematic perspective view of an embodiment of the device according to the invention showing loudspeakers placed in the front face of the device and the port section of the bass-reflex system applied in this embodiment.

With reference to FIG. 1 there is shown a loudspeaker device according to an embodiment of the invention generally indicated by reference numeral 1. The device comprises a housing with a front face 8 that in the shown embodiment is substantially planar, although other shapes (such as curved) could alternatively be used. The housing comprises an inner house portion 3 in which inter alia a plurality of loudspeakers are mounted, as will be described in detail below, and an outer house portion 2, partially surrounding the inner house portion 3 at a distance d from the adjacent surface portions of the inner house portion 3. In FIG. 1, the distance d is substantially constant, such that a gap 6 (see FIG. 2) of substantially constant width is formed between the outer and inner house portions 2 and 3 of the housing. However, the distance d could alternatively vary, thus forming a gap of varying width. At the front face 8 of the inner house portion 3 the gap 6 forms an opening area 7 from which sound can radiate from the gap 6 and into the surroundings as indicated schematically by the arrows P in FIG. 1.

The inner house portion 3 of the housing defines an inner space or cavity 9 (see FIG. 2) of a given volume V, which space or cavity 9 is in acoustical communication at a portion 10 with the region formed by the gap 6. Thereby, sound generated in the inner space 9 can propagate through the gap 6 and be radiated to the surroundings from the opening area 7.

In the embodiment of the device according to the invention the width w of the device 1 is substantially larger than the thickness t of the device 1. The invention is however not limited to this elongate shape of the device and other shapes suitable to provide the principles of the invention may be conceived by a skilled person without thereby deviating from the scope of the invention.

In the front face 8 of the inner house portion 3 of the housing there is in this embodiment mounted four loudspeakers 11, 12, 13, 14 covering a lower portion of the audible frequency range. These loudspeakers are configured to radiate sound directly to the surroundings as indicated by the arrows A (see FIG. 2) and to radiate sound into the inner space or cavity 9 of the inner house portion 3 of the housing as indicated by the arrows B (see FIG. 2).

The inner space or cavity 9 and the gap 6 forms in this embodiment of the invention a Helmholz resonator with an opening or port 7 communicating with the surroundings, and with proper choice of the acoustic parameters of the loudspeakers 11, 12, 13, 14 and the Helmholz resonator, a bass-reflex loudspeaker system can be formed, thereby increasing a portion of the low frequency range of the loudspeaker device.

According to this embodiment of the invention, the opening or port 7 of the bass-reflex system has a large opening area forming an interface between the device and the surroundings that in the shown embodiment surrounds the entire front face 8 of the inner house portion 3. By enlarging the opening or port 7 of the bass-reflex system in this manner, volume velocity in the opening or port 7 is reduced, whereby port noise generated at the opening or port 7 is reduced. Consequently, larger low frequency outputs can be obtained with a good sound quality than would be possible with a relatively small port area such as the opening of a tube between the inner cavity and the surroundings as is traditionally used in bass-reflex enclosures.

The multi-loudspeaker arrangement according to the invention allows an optimal adaptation of the beam direction and beam width of the loudspeaker arrangement to the specific use case.

In addition to the low frequency loudspeakers 11, 12, 13,14 the shown embodiment of the invention comprises left and right loudspeaker combinations 16, 18 and 15, 17 respectively.

In a stereophonic setup the two left loudspeakers 16, 18 can function as a combined left channel loudspeaker, and similarly the two right loudspeakers 15, 17 can function as a combined right channel loudspeaker.

Figure 2:
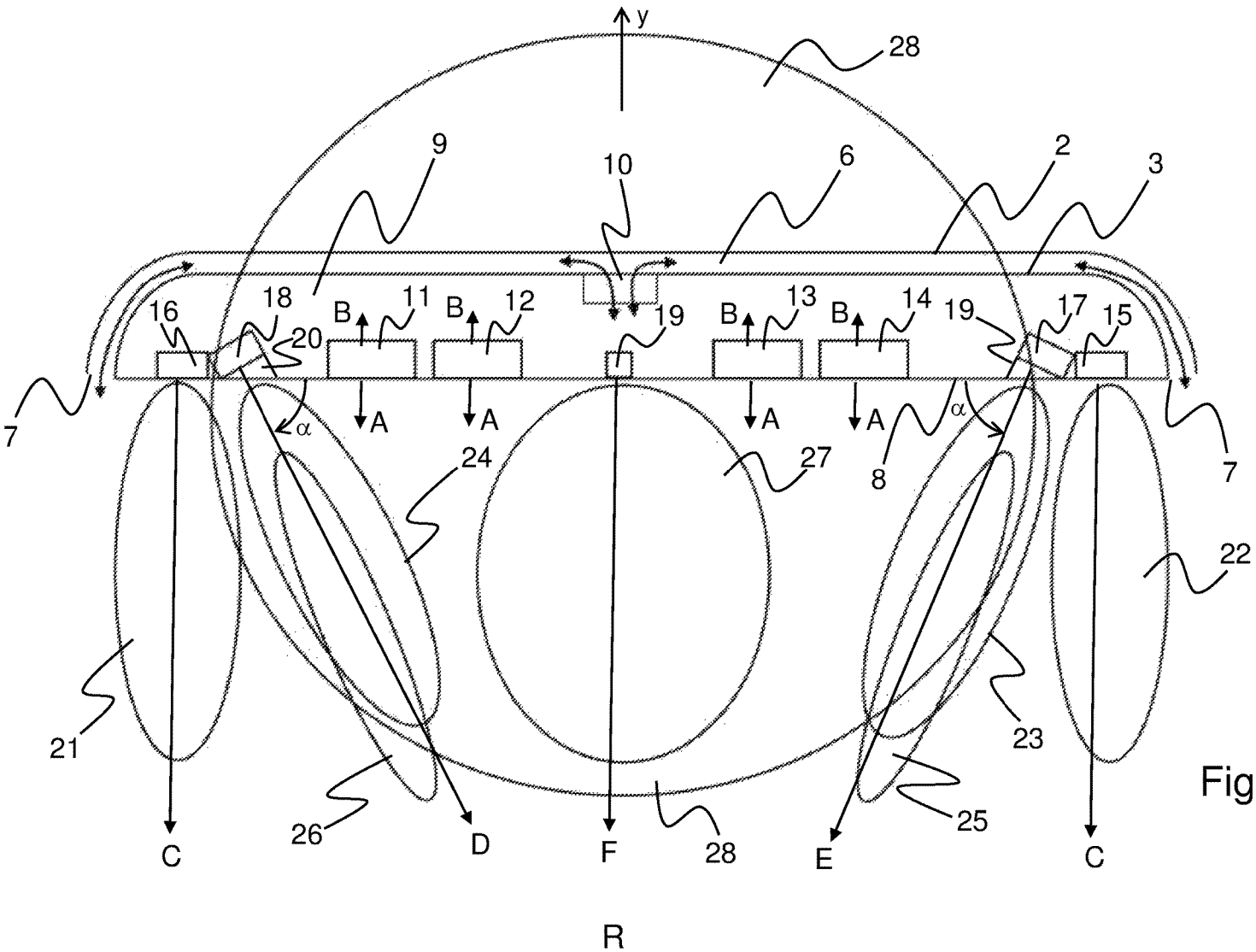
FIG. 2 shows a schematic cross sectional view of the embodiment of the device according to the invention shown in FIG. 1 together with schematic directional characteristics of the various loudspeakers and combination of loudspeakers used in this embodiment of the invention.

The combined left and right channel loudspeakers 16, 18 and 15, 17, respectively, can be used individually to change beam direction from perpendicular to the front face 8 (as indicated by the arrows C in FIG. 2) to an inclined angle relative to the front face 8 (as indicated by the arrows D and E in FIG. 2) with the configuration shown in FIG. 1, or they can be used combined to provide beam width control, as schematically indicated by the zones 25 and 26, respectively in FIG. 2, where the beam width of the beams 25 and 26, respectively, is less than the beam width of beams 21, 22, 23 and 24, respectively.

The centrally placed loudspeaker 19 enables the device to be used as a single-channel speaker, and to for instance use the four loudspeakers 15, 16, 17 and 18 as midrange drivers and the centrally placed loudspeaker 19 as a high frequency diver (tweeter).

In an embodiment of the device according to the invention, the loudspeakers 15, 16, 17, 18 are designed to cover the mid and/or high frequency range of the audible frequencies and the centrally located loudspeaker 19 is designed to cover the high frequencies.

One of the loudspeakers of each pair of right and left loudspeakers 15, 16 (right and left, as seen from the region R in space in front of the loudspeaker device 1) is mounted in the front face 8 such that the axis C of these loudspeakers 15, 16 is substantially perpendicular to the plane (x, y) of the front face 8. The directional characteristics (at a given frequency or in a given frequency range of these loudspeaker's frequency range) are schematically indicated by the zones 21 and 22, respectively.

Adjacent the loudspeaker 15 there is mounted a loudspeaker 17 also radiating sound towards the region R in front of the loudspeaker device 1. The axis E of loudspeaker 17 is however inclined at an angle $\alpha$ in the (x, y) plane relative to the front face 8 in a direction towards the symmetry plane (y, z) of the device. Similarly, a loudspeaker 18 is provided adjacent the loudspeaker 16 with the axis D of loudspeaker 18 inclined an angle $\alpha$ in the (x, y) plane relative to the front face 8 in a direction towards the symmetry plane (y, z) of the device. The directional characteristics of the loudspeakers 17 and 18 are schematically shown by the zones 23 and 24, respectively. The loudspeakers 17 and 18 are tilted relative to the front face 8, and the front face 8 is in the shown embodiment extended by portions 19 between the front face 8 and the respective of these loudspeakers, thus forming an exit region 20 for sound from these loudspeakers. Other mounting arrangements of the loudspeakers 17 and 18 may, however be applied.

In the embodiment shown in FIGS. 1 and 2 (and also in the embodiment shown in FIG. 3) the inclined loudspeakers 17, 18 are positioned closest to the symmetry plane (the (y, z) plane) of the device or system. However, according to alternative embodiments of the device and system according to the invention (not shown) the inclined loudspeakers 17, 18 are placed furthest away from the symmetry plane (for instance substantially at the position of the perpendicularly radiating loudspeakers 15 and 16, respectively) and the perpendicularly radiating loudspeakers 15, 16 are placed closest to the symmetry plane (for instance substantially at the position of the inclined loudspeakers 17 and 18, respectively).

In the central region of the front face 8 there is further provided a loudspeaker 19 designed such that it can emit high frequency sounds. The axis F of loudspeaker 19 is substantially perpendicular to the plane (x, z) of the front face 8 and its directional characteristics (at a given frequency or in a given frequency range) is shown schematically by zone 27 in FIG. 1.

Whereas the directional characteristics of the loudspeakers 15 through 19 have a more or less pronounced main lobe in a direction from the front face 8 and to the region R in front of the device 1, the low frequency loudspeakers 11, 12, 13 and 14 (together with the bass-reflex system as described above) will have a substantially omnidirectional characteristic as shown schematically by the zone 28.

It is specifically noted that although the embodiment of the device according to the invention described in detail above utilizes four low frequency loudspeakers 11, 12, 13 and 4, other embodiments may use different numbers of low frequency loudspeakers.

In still other embodiments of the device according to the invention, low frequency reproduction may be acceptable entirely without the described bass-reflex system. In such embodiments, the housing of the device may consist of only the inner house portion 3 comprising the required number of loudspeakers, for instance those described above.

Figure 3:
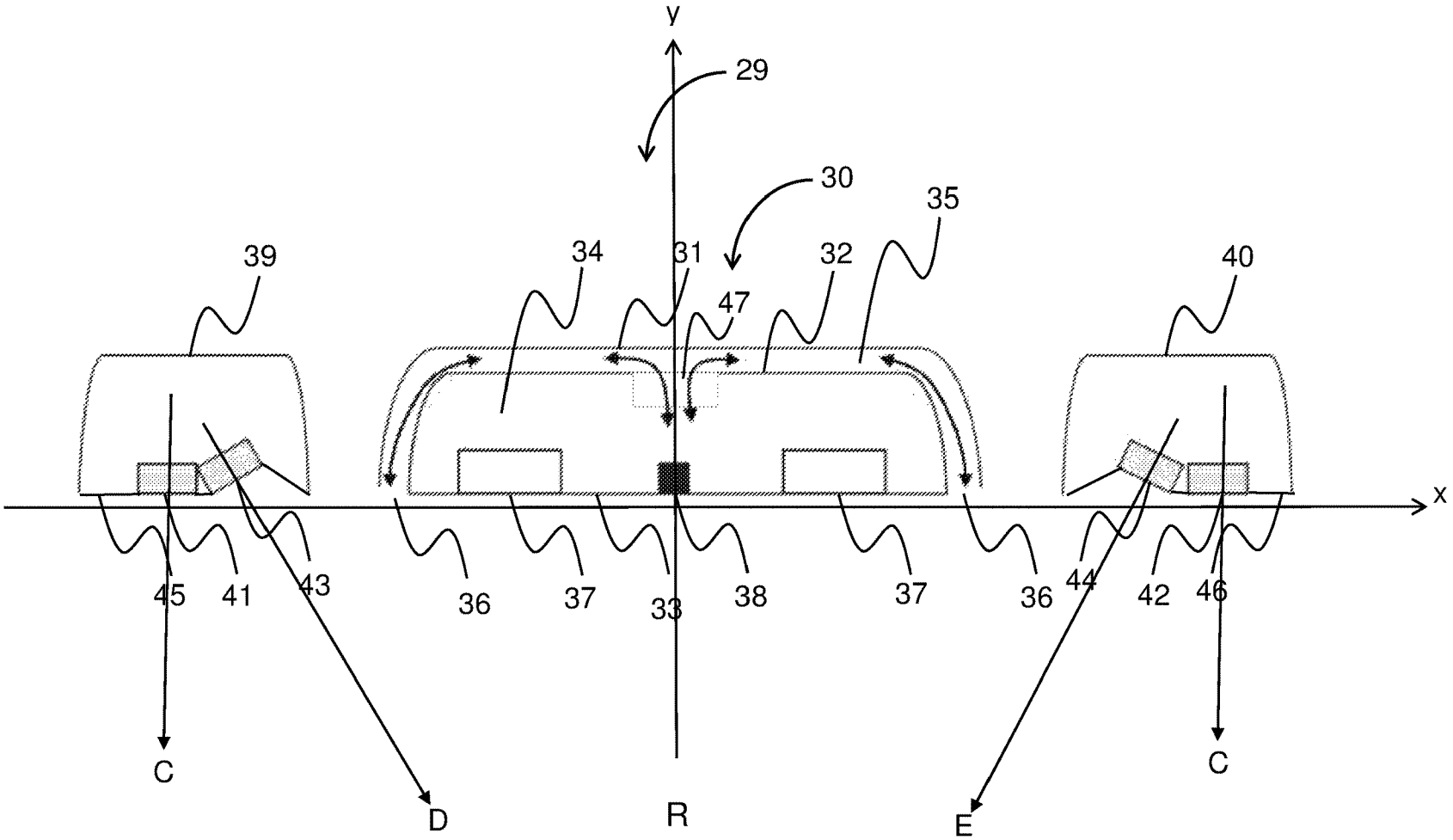
FIG. 3 shows a schematic cross sectional view of an embodiment of a system according to the invention comprising separate left, center and right loudspeaker devices.

With reference to FIG. 3 there is shown a schematic cross sectional view of an embodiment of a system according to the invention generally indicated by reference numeral 29 comprising separate left, center and right loudspeaker devices.

The center loudspeaker device 30 comprises in the shown embodiment an outer house portion 31 partially surrounding an inner house portion 32 basically in the same manner than previously described in connection with the embodiment shown in FIGS. 1 and 2. The inner house portion 32 comprises a front face 33 in which a pair of low frequency loudspeakers 37 are mounted for radiation of sound into the surroundings. The front face 33 is furthermore provided with a centrally located high frequency loudspeaker 38. The inner house portion 32 defines an inner space or cavity 34 which is in acoustic communication with the surroundings through a channel or gap 35 formed between the outer and inner house portions 31 and 32, respectively. This channel or gap 35 opens towards the surroundings at a port section 36. This system forms a bass-reflex enclosure in the manner described in connection with the embodiment shown in FIGS. 1 and 2, and due to the extended port area 36 the previously mentioned port noise reduction is also obtained in the embodiment of FIG. 3.

The system shown in FIG. 3 furthermore comprises a separate left loudspeaker device 39 provided with a front face generally indicated by 45 and a separate right loudspeaker device 40 provided with a front face generally indicated by 46. The left loudspeaker device 39 comprises a loudspeaker 41, the main radiation axis of which is substantially perpendicular to the plane of the front face 45 of the left loudspeaker device 39 and a loudspeaker 43, the main axis of which forms an inclined angle in the (x, y) plane as shown in FIG. 3 relative to the plane of the front face 45. The loudspeaker combination 41, 43 can be controlled substantially as described above in relation to the embodiment of FIGS. 1 and 2 to obtain a desired variation of beam direction and beam width of the radiated sound.

The right loudspeaker device 40 comprises a loudspeaker 42, the main radiation axis of which is substantially perpendicular to the plane of the front face 46 of the right loudspeaker device 40 and a loudspeaker 44, the main axis of which forms an inclined angle in the (x, y) plane relative to the plane of the front face 46. The loudspeaker combination 42, 44 can be controlled substantially as described above in relation to the embodiment of FIGS. 1 and 2 to obtain a desired variation of beam direction and beam width of the radiated sound.

In an embodiment of the system according to the invention the front faces 33, 45 and 46 of the three separate loudspeaker devices 30, 39, 40 are substantially located in the same plane as shown in FIG. 3. It is however also possible according to the invention to position the individual loudspeaker devices 30, 39 and 40 without their respective front faces 33, 45 and 46 being located in a common plane. Thus, for instance the loudspeaker devices 39 and 40 may be shifted in the direction of the y-axis relative to the loudspeaker device 30. Alternatively—or in combination herewith—the loudspeaker devices 39 and 40 may be rotated relative to the loudspeaker device 30, such that the respective front faces 45 and 46 forms an angle relative to the front face 33 of the loudspeaker device 30. The provision of the loudspeaker system according to the embodiment of the invention shown in FIG. 3 offers increased flexibility of the actual relative location of the various individual loudspeakers, such as those shown in the FIGS. 1 and 2.

The device according to the present invention may, as an example, be used as a sound bar in a television set, or configured as a stereo audio rendering device. The sound beams from the various loudspeakers in the device are configured accordingly. When used in a stereophonic setup, the loudspeakers 11, 12, 16 and 18 may be assigned to the left channel, and the loudspeakers 13, 14, 15 and 17 may be assigned to the right channel.

Figure 4:
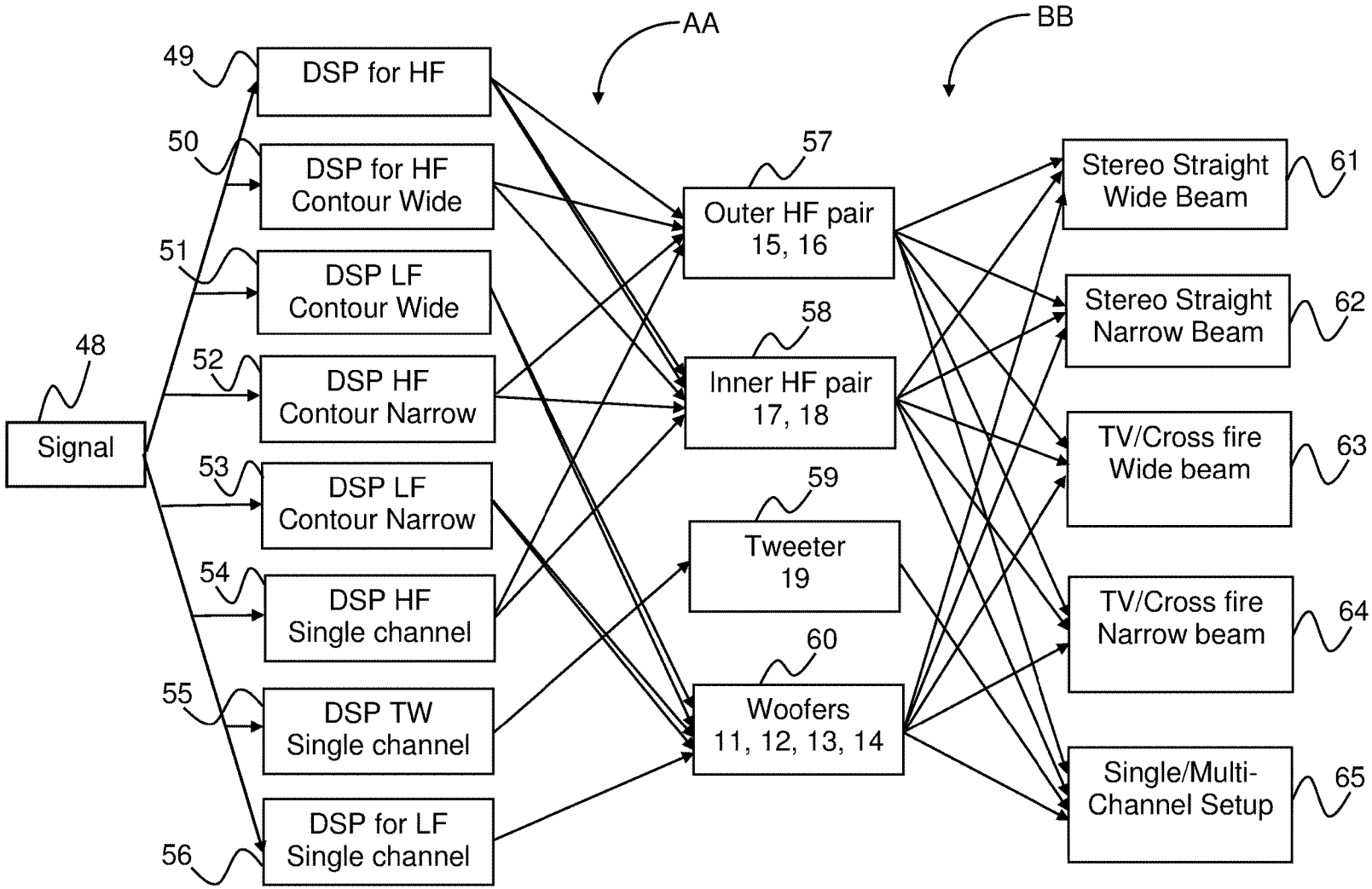
FIG. 4 shows a schematic block diagram of a control system configured to control the directional characteristic of the various loudspeakers of the system or device according to the invention.

With reference to FIG. 4 there is shown a schematic block diagram of an embodiment of a control system configured to control the directional characteristic of the various loudspeakers of the system or device according to the invention.

The control system comprises a plurality of digital processing (DSP) units 49 through 56 configured for receiving and processing an input signal 48 which may either be a single channel (mono) signal or a multi-channel signal, such as a two channel (stereo) signal.

The DSP units are in an embodiment of a control system according to the invention configured to provide one or more output signals that can be any combinations of frequency weighted, time-delayed, phase-modified or gain-modified versions of the respective input signal. It is noted that further signal processing may take place in the DSP units and that such processing would also fall within the scope of the present invention.

Processed output signals from the DSP units 49 (DSP for HF), 50 (DSP for HF contour wide), 52 (DSP HF contour narrow) and 54 (DSP HF single channel) are provided to the outer (or perpendicularly oriented) loudspeakers 15 and 16 as indicated at 57 in FIG. 4.

Processed output signals from the DSP units 49 (DSP for HF), 50 (DSP for HF contour wide), 52 (DSP HF contour narrow) and 54 (DSP HF single channel) are provided to the inner (or inclined) loudspeakers 17 and 18 as indicated at 58 in FIG. 4.

Processed output signals from the DSP units 55 (DSP TW single channel) are provided to the centrally located high frequency loudspeaker (tweeter) 19 as indicated at 59 in FIG. 4.

Processed output signals from the DSP units 51 (DSP LF contour wide), 53 (DSP LF contour narrow) and 56 (DSP for LF single channel) are provided to the low frequency loudspeakers (woofers) 11, 12, 13, 14 as indicated at 60 in FIG. 4.

The provision of the respective processed output signals to the respective loudspeakers as described above is indicated by the arrow lines shown at AA in FIG. 4.

Dependent on the specific signal processing carried out in the DSP units 49 through 56 the sound images symbolically indicated by reference numerals 61 through 65 can be obtained. Thus radiation from a combination of the outer HF pair of loudspeakers 15 and 16, the inner HF pair of loudspeakers 17 and 18, and the woofers 11, 12, 13, 14 can provide a stereo straight wide beam pattern 61.

Alternatively, by appropriate signal processing in the DSP units 49 through 56 combined radiation from the above loudspeakers can provide a stereo straight narrow beam pattern 62, a TV/Cross fire wide beam pattern 63, or a TV/Cross fire narrow beam pattern 64. Radiation from the tweeter 19 can, in the embodiment shown in FIG. 4, be combined with radiation from the other loudspeakers in the setup to yield a Single/Multi-Channel setup 65.

As schematically shown in FIG. 4, the output from the respective DSP units 49 through 56 are provided to chosen loudspeakers in the system or device. This is symbolically indicated by the arrows AA in FIG. 4, but it is understood that according to the invention it is possible to select which outputs from respective DSP units should be provided to the different loudspeakers. This selection can take place for instance by means of a output selector (an output selection means) that routes the respective output signals to the desired loudspeakers. This selector is not shown in FIG. 4.

It is noted that although the control system shown in FIG. 4 comprises individual DSP units or processors, other implementations of the control system may also be conceived that does not have the specific layout shown in FIG. 4. Such systems or software implementations would also fall within the scope of the present invention.

With reference to FIGS. 5*a*, 5*b*, 5*c* and 5*d* there are shown examples of directional characteristics of a loudspeaker system or device according to an embodiment of the present invention provided with the embodiment of a control system shown in FIG. 4.

Figure 5A:
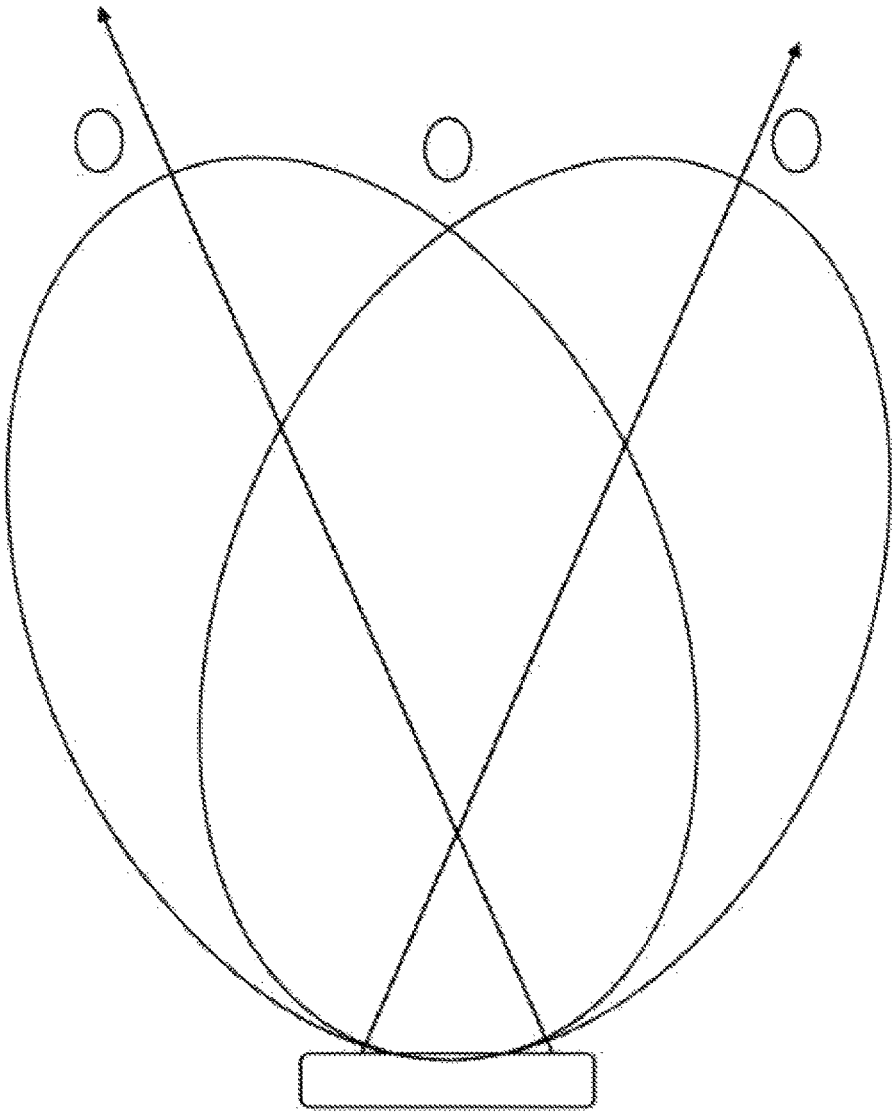
FIGS. 5*a*, 5*b*, 5*c* and 5*d* show examples of directional characteristics of a loudspeaker device according to an embodiment of the present invention provided with a control system as shown in FIG. 4.

FIG. 5*a* illustrates an example of a cross fire wide beam directional characteristic 70 (at e given frequency) of a left loudspeaker combination, where the directional characteristic has a main lobe in the direction 71 that is inclined relative to the front face of the system/device. It is noted that the radiation direction 71 is towards the right side of the system/device. Similarly the right loudspeaker combination has a directional characteristic 72 pointing to the left relative to the system/device with the axis of the main lobe indicated by 73. Three different listening positions in front of the system/device are indicated by 67, 68 and 69, respectively.

Figure 5B:
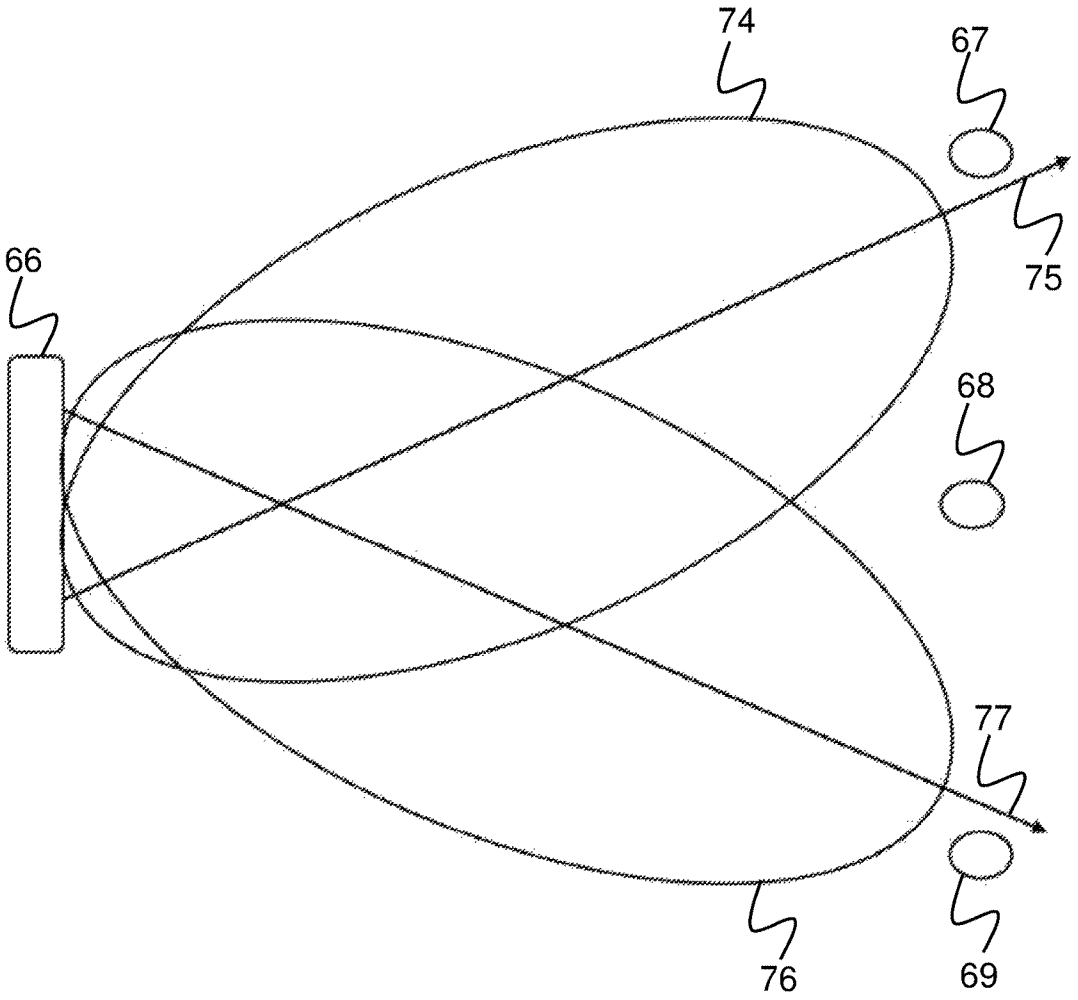

FIG. 5*b* illustrates an example of a cross fire narrow beam directional characteristic 74 (at e given frequency) of a left loudspeaker combination, where the directional characteristic has a main lobe in the direction 75 that is inclined relative to the front face of the system/device. It is noted that the radiation direction 75 is towards the right side of the system/device. Similarly the right loudspeaker combination has a directional characteristic 76 pointing to the left relative to the system/device with the axis of the main lobe indicated by 77. Three different listening positions in front of the system/device are indicated by 67, 68 and 69, respectively.

Figure 5C:
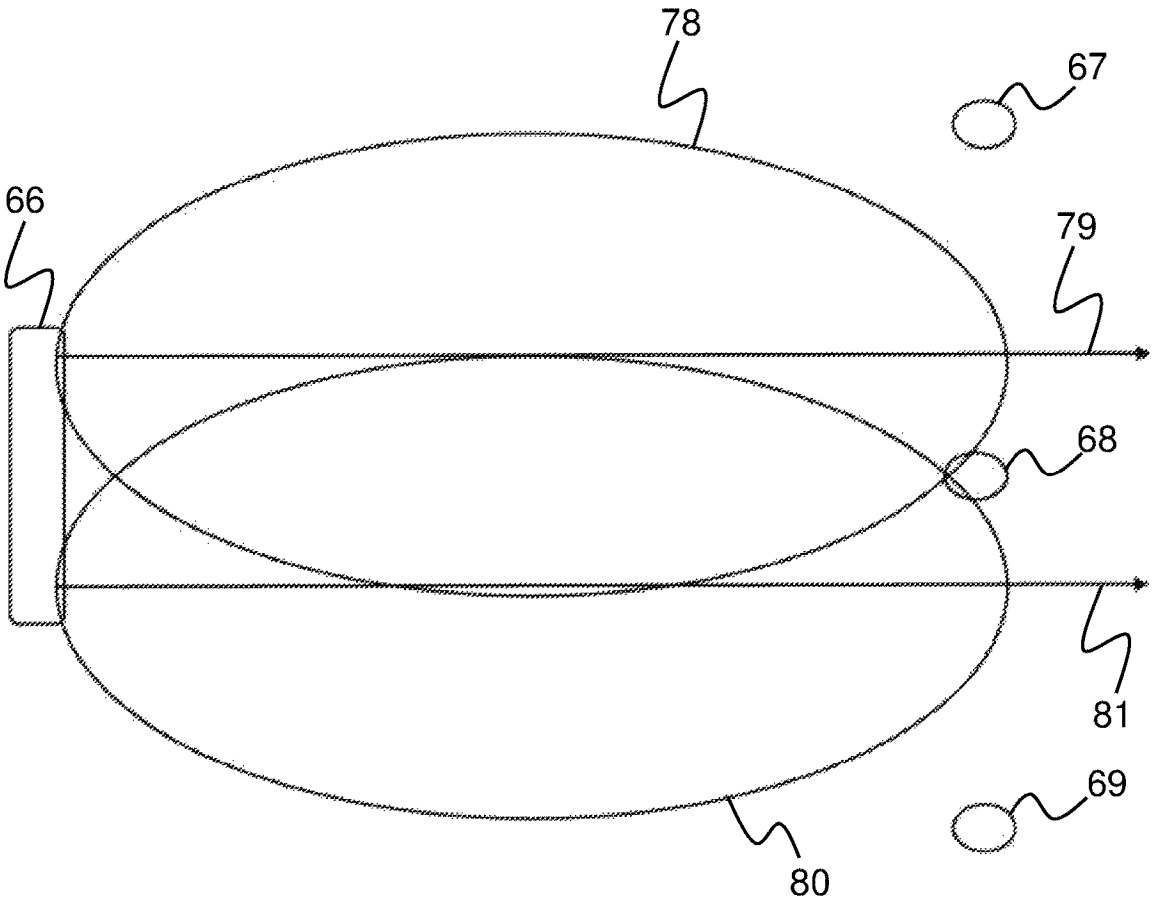

FIG. 5*c* illustrates an example of a stereo straight narrow beam directional characteristic (at a given frequency) 80 of a left loudspeaker combination, where the directional characteristic has a main lobe in the direction 81. Similarly the right loudspeaker combination has a directional characteristic 78 with a main lobe indicated by 79. Three different listening positions in front of the system/device are indicated by 67, 68 and 69, respectively.

Figure 5D:
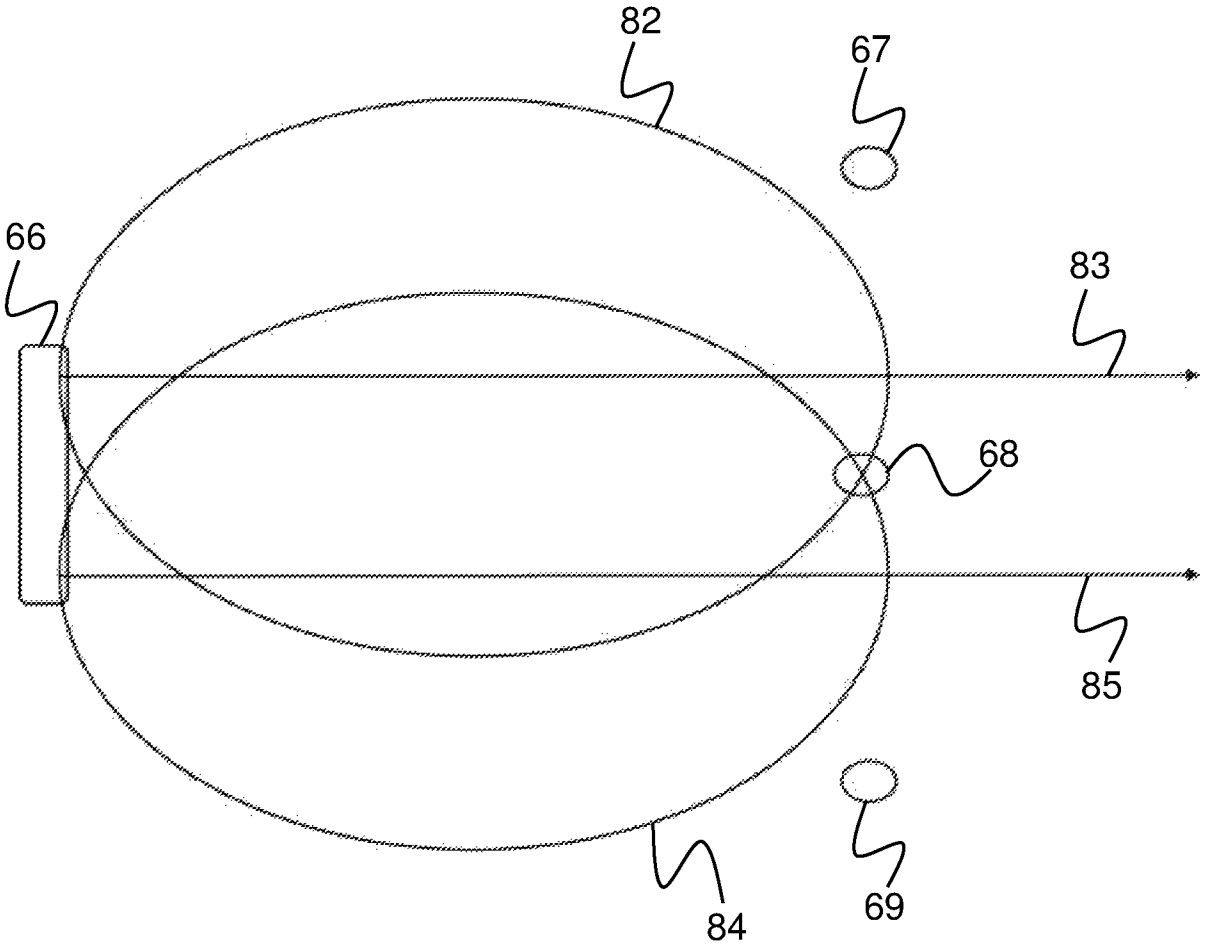

FIG. 5*d* illustrates an example of a stereo straight wide beam directional characteristic (at a given frequency) 84 of a left loudspeaker combination, where the directional characteristic has a main lobe in the direction 85. Similarly the right loudspeaker combination has a directional characteristic 82 with a main lobe indicated by 83. Three different listening positions in front of the system/device are indicated by 67, 68 and 69, respectively.

When configured as a sound bar for TV use, the loudspeakers are driven such that the sound image is perceived in the middle of the screen.

Alternative modes of operation of the device according to the invention are:

Single channel;
Centre
Stereo
TV mode compensation
Ambient

The width and direction of sound radiation are according to an embodiment of the invention controlled by configuration of the loudspeakers in the following manner:

(1) In a normal stereo setup the loudspeakers with axes substantially perpendicular to the plane P of the front face 8 (i.e. loudspeakers 11, 12, 13, 14, 15, 16 and 19) will each have a beam width defined by the actual physical dimensions of the respective loudspeaker. The high frequencies will be more directive and the lower frequencies less. By adding a time and frequency optimized output from the angled loudspeakers 17, 18 at lower frequencies where the corresponding perpendicularly oriented loudspeaker 15, 16 is less directive, the directivity of the combined loudspeakers 15, 17 and 16, 18 respectively can be increased. Alternatively, by adding output from the angled loudspeakers 17, 18 at high frequencies where the corresponding perpendicularly oriented loudspeaker 15, 16 is more directive, the directivity of the respective loudspeaker combinations 15, 17 and 16, 18 can be reduced, thereby creating an output with less change of directivity versus frequency.

(2) In a setup where the angled loudspeakers 17, 18 are functioning as the main loudspeakers of the device, and where a cross firing direction of sound is wanted, as indicated for instance by arrows D and E in FIG. 1, the addition of a time and frequency optimized output from the loudspeakers 15 and 16 that radiates sound substantially perpendicularly to the plane P of the front face 8, will increase the directivity at lower frequencies, and furthermore, the directivity at high can be reduced by adding output from the perpendicularly radiating loudspeakers 15 and 16 to the sound radiated from the angled loudspeakers 17 and 18, respectively, the directivity of which is relatively high at high frequencies.

(3) In either of the above setups the combination of two loudspeakers (15 and 17; and 16 and 18, respectively) can provide controlled (for instance reduced) directivity compared to sound radiation from only a single loudspeaker of the respective pair of loudspeakers.

(4) In either of the above setups, and in the frequency bands where the two loudspeakers (15 and 17; 16 and 18, respectively) have overlapping radiation patterns, a time and frequency optimized input to both of the respective loudspeakers, i.e. to loudspeakers 15 and 17; and 16 and 18, respectively, will make it possible to control the direction of the combined main sound beam (the main lobe of the directivity characteristic).

(5) The orientation of the loudspeakers determines the orientation of the main axis of high frequency radiation, and therefore defines the main axis for a full frequency control of the beam width.

It is noted that for different widths w of the device 1 (see FIG. 1), a different angle of radiation will be optimum to cover for different use cases. A wider device will require decreased angles α and β of the inclined loudspeakers 17 and 18 relative to the front face 8, and a device of less width will require smaller angles α and β.

(6) By using the sound output from the low frequency loudspeakers 11, 12, 13, 14 in a time and frequency optimized manner, the beam width can be further controlled in the lower frequencies of the bass band of the four outer loudspeakers 15, 16, 17, 18.

(7) The centrally located high frequency loudspeaker 19 can be used to obtain optimal radiation when the device according to the invention is used as a mono loudspeaker in a multichannel or two channel setup.

The centrally located loudspeaker 19 can in this case cover frequencies as low as possible dependent on the physical/acoustic characteristics of the loudspeaker 19, such as for instance frequencies from approximately 2 kHz upwards, and the four outer loudspeakers 15, 16, 17 and 18 can cover mid frequencies from for instance 200 to 300 Hz upwards to the frequency range of the centrally located loudspeaker 19, for instance upwards to approximately 2 kHz.

The low frequency loudspeakers 11, 12, 13 and 14 will cover the frequencies below approximately 200 to 300 Hz.

(8) In a mono configuration of the device according to the invention an addition of a time and frequency optimized signal to the four mid frequency loudspeakers 15, 16, 17, 18 will allow a control of the beam width at the lower frequency range of the centrally located high frequency loudspeaker 19, at which frequency range the directivity of loudspeaker 19 is relatively low, thereby obtaining a more uniform radiation of sound energy versus frequency.

(9) As mentioned under (6) above, the low frequency loudspeakers 11, 12, 13, 14 can be used to further control the beam width in the mono configuration of the device.

The size of the respective loudspeakers will influence the frequency range and directional characteristics of each individual loudspeaker in the device. According to the invention, beam width control is achieved by controlled overlap of frequency ranges and delays of the respective loudspeakers.

Typical—but by no means the only possible—characteristics of the loudspeakers used in the embodiment of the invention described above are:

Loudspeakers 15, 16, 17 and 18 are 1.5"loudspeakers with a frequency range of approximately 300 Hz to 20 kHz in STEREO and VIDEO mode and approximately 300 Hz to 2 kHz in MONO mode.

Loudspeakers 11, 12, 13, and 14 are low frequency loudspeakers typically covering a frequency range of approximately 20 Hz to 300 Hz. However, if these loudspeakers are used for beam width control (as described above) the upper frequency limit will be higher, for instance approximately 1 kHz.

The centrally located high frequency loudspeaker 19 will typically be a tweeter with a frequency range from 2 kHz upwards.

The centrally located loudspeaker is mainly (although not necessarily exclusively) used to optimize the device for mono reproduction.

Figure 6:
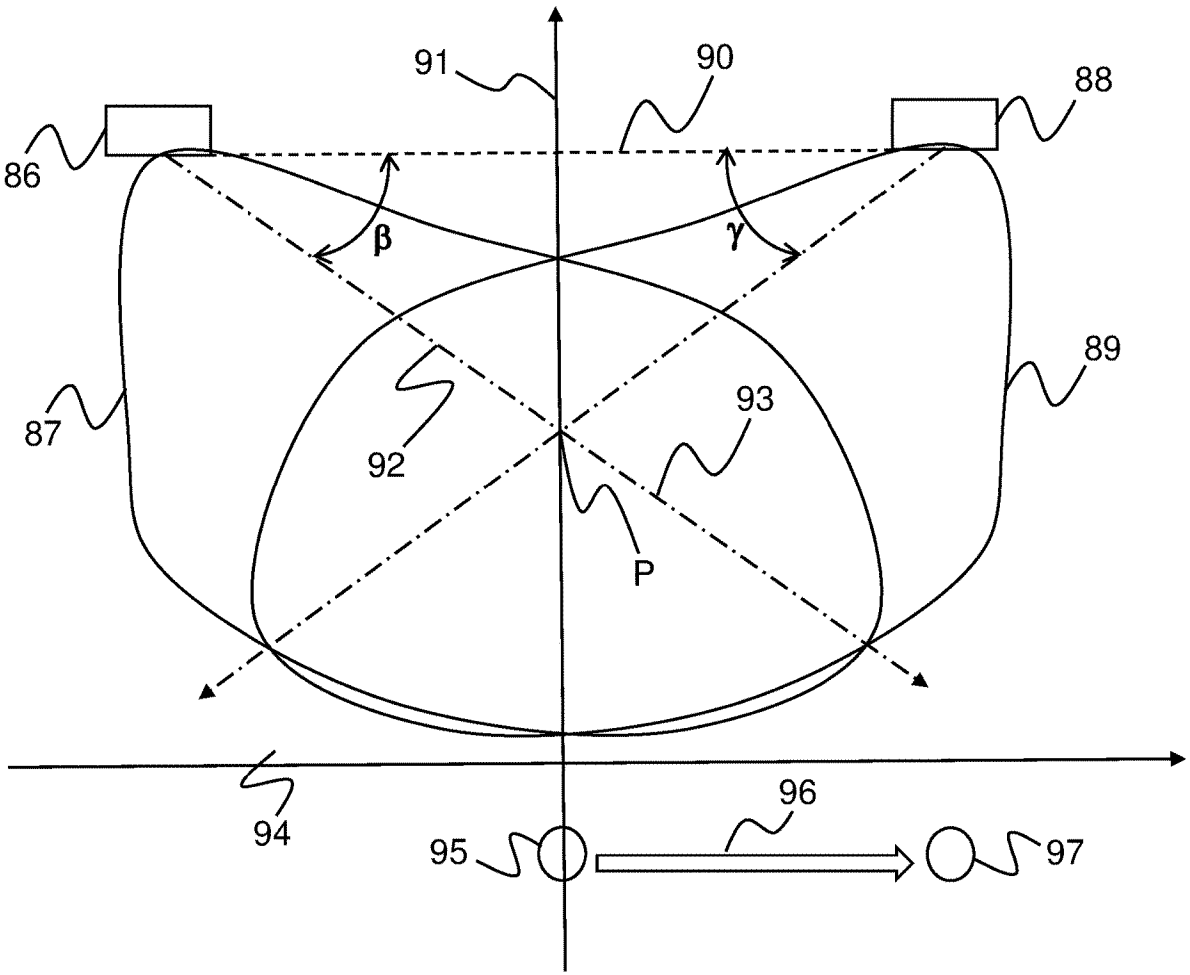
FIG. 6 shows an illustration of an example of directional characteristics of the Left and Right loudspeaker arrangements that provides a stereo image stabilizing effect.

With reference to FIG. 6 there is shown an illustration of an example of directional characteristics of the Left and Right loudspeaker arrangements that provides a stereo image stabilizing effect.

The directional characteristics 87 and 89, respectively, of the combined loudspeakers in the Left loudspeaker arrangement 86 and the combined loudspeakers in the Right loudspeaker arrangement 88, respectively, have in this embodiment of the invention a relatively large beam width with maximum sound radiation at an inclined angle β (for Left loudspeaker arrangement) and γ (for Right loudspeaker arrangement), respectively, relative to the front face or line 90 of the loudspeaker device or system, where the direction of the maximum of the respective directional characteristic 87, 89 points towards a point P in front of the loudspeaker device or system at a certain distance from the front face or line 90 of the device or system. When configured in this manner, the provision of the respective Left and Right loudspeaker arrangements 86, 88 with identical electrical signals (for instance representing a singer located in the symmetry plane 91 of the loudspeaker set-up) will result in that a listener located in the symmetry plane (for instance at point 95) at a distance in front of the loudspeaker device or system will receive equally strong sound signals from either of the loudspeaker arrangements 86, 88 and hence will perceive the sound image (of the singer) in the desired position in the symmetry plane 91. When the listener is for instance moving laterally to the right as indicated by arrow 96, still keeping the same distance from the line 90 between the respective loudspeaker arrangements 86, 88, the magnitude of the sound radiated by the Right loudspeaker arrangement 88 will decrease due to the directional characteristic 89 of the Right loudspeaker arrangement 88, whereas the magnitude of the sound radiated by the Left loudspeaker arrangement 86 will increase due to the directional characteristic 87 of the left loudspeaker arrangement 86. With a proper choice of directional characteristics of the respective loudspeaker arrangements, this will have the effect that the perceived sound image (in this example of the singer) will remain substantially at its original position in the symmetry plane 91 despite the fact that the listener has moved laterally relative to the device or system to a new position as for instance indicated at 97 in FIG. 6. Consequently, a stereo image stabilizing effect has been achieved as desired.

Ideally, not only the respective directional characteristics 87, 89 must be taken into account when designing the device or system with focus on the stereo-stabilizing effect, but also the distances between the listener and the respective Left and Right loudspeaker arrangements must be taken into account. The following expression may be used for determining optimal stereo-stabilizing effect:

$$\left|\frac{D_R(\gamma)}{D_L(\beta)}\right| \cdot \left|\frac{r_L(\beta)}{r_R(\gamma)}\right| = C$$

where:

β and γ are the respective angles indicated in FIG. 6;

$D_R(\gamma)$ is the magnitude of the directional characteristic of the Right loudspeaker arrangement 88 in direction γ;

$D_L(\beta)$ is the magnitude of the directional characteristic of the Left loudspeaker arrangement 86 in direction β;

$r_L(\beta)$ is the distance between the Left loudspeaker arrangement 86 and the listener; and $r_R(\gamma)$ is the distance between the Right loudspeaker arrangement 88 and the listener.

In order to obtain optimal stereo-stabilizing effect, the quantity C should be constant for all values of γ and β relevant in the specific set-up.

For the symmetric set-up shown in FIG. 6, C should be as close to unity for all values of γ and β. In the symmetry plane 91, C will for this set-up be exactly 1.

Generally, it should be noted that the directional characteristics 87, 89 are not only functions of the respective angles γ and β but also of frequency. Thus, the above requirements should ideally be fulfilled for all frequencies within the frequency ranges of the Left and Right loudspeaker arrangements, or at least for those frequency ranges that are of most importance for forming the stereo image.

Although the invention has been explained in relation to the embodiments described above, it is to be understood that many other possible modifications and variations can be made without departing from the scope of the present invention. Thus, for instance, the number of low frequency loudspeakers may be reduced to two instead of the four described above. Similarly, in some embodiments, the centrally located loudspeaker 19 may be omitted. Furthermore, the shape and exact geometric details of the device of the invention may in some embodiments deviate from that shown in the figures. It is, therefore, contemplated that the appended claim or claims will cover such modifications and variations that fall within the true scope of the invention.

It is furthermore specifically noted that although the central low frequency portion of the system or device comprising the low frequency loudspeakers and—in some embodiments—the bass-reflex system according to the invention and the respective left and right portions of the system or device comprising loudspeaker combinations with controllable directional characteristics have been described as an integrated system of device it is possible to use these respective portions separately and possibly in connections with other entities than those described above. Thus, the applicant reserves his right to file divisional applications covering these aspects of the invention.

The invention claimed is:

1. A loudspeaker system configured such that a sound field generated by the loudspeaker system is controllable, comprising:

Left and Right loudspeaker arrangements configured for radiating at least mid and high frequency sounds to surroundings and for controlling a sound radiation pattern of the left and right loudspeaker arrangements, respectively, such that the beam width and/or direction of a main lobe of a directivity pattern for the respective Left and Right loudspeaker arrangements is variable;

at least one signal processor configured to process the signals to be provided to loudspeakers of the respective loudspeaker arrangements such that directional characteristics of the loudspeakers in each respective arrangement is variable;

wherein the resulting directional characteristic of the system can be adapted to specific use situations;

wherein the system further comprises a low frequency arrangement comprising an arrangement of one or more loudspeakers mounted in an enclosure and configured such that the loudspeakers radiate sound energy to the surroundings; and wherein said enclosure comprises an inner house portion and an outer house portion, where the outer house portion partially surrounds the inner house portion, thereby forming a channel or gap between the inner and outer house portions, and where the inner house portion defines an inner space or cavity that is in acoustic communication via a portion with said channel or gap, the portion defining an inlet area to the channel or gap, and where said channel or gap is in acoustic communication with the surroundings via an outlet opening or port defining a port area and wherein said one or more loudspeakers are configured to radiate sound energy into said space or cavity, and wherein said port area is substantially larger than said inlet area, thereby reducing the volume velocity of the sound in the port area substantially relative to the volume velocity of the sound in the inlet area, wherein port noise is reduced and consequently the sound quality of the sound produced by the system at low frequencies is improved.

2. The loudspeaker system according to claim 1, wherein said Left loudspeaker arrangement comprises at least two loudspeakers provided in a front face of the Left loudspeaker arrangements, and wherein said Right loudspeaker arrangement comprises at least two loudspeakers provided in a front face of the Right loudspeaker arrangements, with at least one first loudspeaker in the respective arrangement having an axis substantially perpendicular to the front face of the respective arrangement and at least one second loudspeaker having an axis that is inclined an angle substantially different from the axis of the first loudspeaker.

3. A loudspeaker system according to claim 1, wherein said at least two loudspeakers in the Left loudspeaker arrangement are provided side by side in a lateral direction of the system, and wherein said at least two loudspeakers in the Right loudspeaker arrangement are provided side by side in the lateral direction of the system.

4. The loudspeaker system according to claim 1, wherein said enclosure is configured as a bass-reflex enclosure, which is provided with a bass-reflex sound channel having an inlet area configured to receive a sound energy from the loudspeakers in the low frequency arrangement and an exit area or a port area configured to provide the sound energy to the surroundings, wherein the port area is substantially larger than the inlet area, such that a volume velocity of sound generated by said loudspeakers in the channel is reduced in the port area relative to the inlet area leading to reduced port noise, wherein sound quality at low frequencies is improved, when high intensity low frequency sounds are reproduced by the low frequency arrangement.

5. The loudspeaker system according to claim 1, wherein the system is configured substantially symmetrically about a symmetry plane such that said Left and Right loudspeaker arrangements, respectively are positioned substantially symmetrically about the symmetry plane in the lateral direction of the system.

6. The loudspeaker system according to claim 5, wherein the system comprises at least one high frequency loudspeaker, at least one of which is located substantially at the symmetry plane of the system.

7. The loudspeaker system according to claim 1, wherein the loudspeaker system is provided with a control system configured to control the directional characteristics of the individual loudspeakers of the loudspeaker system, the control system comprising:

a plurality of digital signal processors, each of the digital signal processors having an input and an output, each of the digital signal processors configured to provide a processed version of an input signal at the output of the respective processor 9f the digital signal processors;

an input terminal for receiving the input signal;

output terminals for providing processed versions of the input signal to the respective loudspeakers;

an output selector configured to select processed outputs from one or more of the digital signal processors and to provide the selected outputs to predefined loudspeakers in the system.

8. The loudspeaker system according to claim 7, wherein said digital signal processors are configured to provide an output that is any combination of frequency weighted, time-delayed, phase-modified or gain-modified versions of the input to the respective one of the digital signal processors.

9. The loudspeaker system according to claim 1, wherein the respective directional characteristics (87, 89) of the Left (86) and Right (88) loudspeaker arrangements are optimized to provide a stabilizing effect on a stereo-image perceived by a listener at different positions (95, 97) in front of the loudspeaker system.

10. The loudspeaker system according to claim 9, wherein the direction of the main lobe of the directional characteristic of the Left loudspeaker arrangement (86) is inclined at a first angle relative to a line between the Left and Right loudspeaker arrangement and wherein the direction of the main lobe of the directional characteristic of the Right loudspeaker arrangement is inclined at a second angle relative to the line between the Left and Right loudspeaker arrangement, wherein the first and second angles are less than 90 degrees.

11. The loudspeaker system according to claim 10, wherein for listening points located in the lateral direction on a line in front of and substantially parallel to said line between the Left and Right loudspeaker arrangements the ratio between the magnitudes of the directional characteristic of the Right loudspeaker arrangement and the magnitude of the directional characteristic of the Left loudspeaker arrangement is substantially equal to a particular quantity multiplied by the ratio between the distance between the Right loudspeaker arrangement and the listening point and the distance between the Left loudspeaker arrangement and the listening point.

12. The loudspeaker system according to claim 11, wherein the particular quantity G is substantially constant within a predetermined frequency range.

13. A method for stabilizing a stereophonic sound image provided by a system according to claim 1, where the sound image is created by a Left loudspeaker arrangement and a Right loudspeaker arrangement placed a given distance apart along a line, where the respective directional characteristics of the Left and Right loudspeaker arrangements are chosen such that at a listening point in front of the loudspeaker arrangements at a given distance from the line, the ratio between the magnitude of the directional characteristics is substantially equal to a particular quantity multiplied by the ratio between the distance from the Left loudspeaker arrangement to the listening point L and the distance from the right loudspeaker arrangement to the listening point.

14. The method according to claim 13, wherein the particular quantity is substantially constant.

15. The method according to claim 13, wherein the particular quantity is substantially equal to unity.

16. A loudspeaker device configured such that a sound field generated by the loudspeaker device is controllable, comprising:

a housing provided with a front face extending substantially in a lateral direction;

a Left loudspeaker arrangement comprising at least two loudspeakers provided in the front face and configured to radiate sound energy into surroundings; and a Right loudspeaker arrangement comprising at least two loudspeakers provided in the front face to the right of said left loudspeaker arrangement and configured to radiate sound energy into the surroundings;

wherein a first of said loudspeakers in the Left loudspeaker arrangement has a loudspeaker axis oriented substantially perpendicular the front face and a second of said loudspeakers in the Left loudspeaker arrangement has a loudspeaker axis extending at a first angle in the plane relative to the loudspeaker axis of the first loudspeaker that differs from zero; and wherein a first of said loudspeakers in the Right loudspeaker arrangement has a loudspeaker axis oriented substantially perpendicular the front face and a second of said loudspeakers in the Right loudspeaker arrangement has a loudspeaker axis extending at a second angle in the plane relative to the loudspeaker axis of the first loudspeaker that differs from zero;

wherein the device further comprising one or more low frequency loudspeakers configured to radiate sound energy into the surroundings; and wherein said housing comprises an inner house portion and an outer house portion, where the outer house portion partially surrounds the inner house portion thereby forming a channel or a gap between the inner and outer house portions, and where the inner house portion defines an inner space or a cavity that is in acoustic communication via a portion with said channel or gap, the portion defining an inlet area to the channel or the gap, and where said channel or the gap is in acoustic communication with the surroundings via an outlet opening or a port defining a port area, and wherein said one or more loudspeakers, are configured to radiate sound energy into said space or the cavity, and where said port area is substantially larger than said inlet area, thereby reducing the volume velocity of the sound in the port area substantially relative to the volume velocity of the sound in the inlet area, wherein port noise is reduced and consequently the sound quality of the sound produced by the system at low frequencies is improved when high intensity low frequency sounds are reproduced by the low frequency arrangement.

17. The loudspeaker device according to claim 16, wherein said low frequency loudspeakers are provided in said front face.

18. The loudspeaker device according to claim 16, wherein said housing has a generally elongated shape extending in a lateral direction on either side of a symmetry plane.

19. The loudspeaker device according to claim 18, wherein one of the loudspeakers in said Left loudspeaker arrangement has a loudspeaker axes that points in a direction towards said symmetry plane, and wherein one of the loudspeakers in said Right loudspeaker arrangement has a loudspeaker axes that points in a direction towards said symmetry plane.

20. The loudspeaker device according to claim 18, wherein the device is substantially symmetrical about said symmetry plane.

21. The loudspeaker device according to claim 16, wherein the device further comprises a high frequency loudspeaker provided in the front face.

22. The loudspeaker device according to claim 21, wherein said high frequency loudspeaker is provided substantially in said reference plane.

23. The loudspeaker device according to claim 16, wherein the loudspeaker device is provided with a control system configured to control the directional characteristics of the individual loudspeakers of the loudspeaker device, the control system comprising:

a plurality of digital signal processors each of the digital signal processors having an input and an output, each of the digital signal processors configured to provide a processed version of an input signal at the output of the respective one of the digital signal processors;

an input terminal for receiving the input signal;

output terminals for providing processed versions of the input signal to the respective loudspeakers;

an output selector configured to select processed outputs from one or more of the digital signal processors and to provide the selected outputs to predefined loudspeakers in the loudspeaker device.

24. The loudspeaker device according to claim 23, wherein said digital signal processors are configured to provide an output that is any combination of frequency weighted, time-delayed, phase-modified or gain-modified versions of the input to the respective one of the digital signal processors.

25. The loudspeaker device according to claim 16, wherein the respective directional characteristics of the Left and Right loudspeaker arrangements are optimized to provide a stabilizing effect on a stereo-image perceived by a listener at different positions in front of the loudspeaker device.

26. The loudspeaker device according to claim 25, wherein the direction of a main lobe of the directional characteristic of the Left loudspeaker arrangement is inclined at a first angle relative to a line between the Left and Right loudspeaker arrangement and wherein the direction of the main lobe of the directional characteristic of the Right loudspeaker arrangement is inclined at a second angle relative to the line between the Left and Right loudspeaker arrangement, wherein the first and second angles are less than 90 degrees.

27. The loudspeaker device according to claim 26, wherein for listening points located in the lateral direction on a line in front of and substantially parallel to said line between the Left and Right loudspeaker arrangements the ratio between the magnitudes of the directional characteristic of the Right loudspeaker arrangement and the magnitude of the directional characteristic of the Left loudspeaker arrangement is substantially equal to a particular quantity multiplied by the ratio between the distance between the Right loudspeaker arrangement and the listening point and the distance between the Left loudspeaker arrangement and the listening point.

28. The loudspeaker system according to claim 27, wherein the particular quantity is substantially constant within a predetermined frequency range.

* * * * *